US009056507B2

(12) United States Patent
Murai et al.

(10) Patent No.: US 9,056,507 B2
(45) Date of Patent: Jun. 16, 2015

(54) TAPE PRINTING DEVICE WITH ADHESIVE TRANSFER MECHANISM BEFORE PRINTING SECTION

(71) Applicant: CASIO COMPUTER CO., LTD., Shibuya-ku, Tokyo (JP)

(72) Inventors: Yasushi Murai, Ome (JP); Akio Tsuji, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 13/949,846

(22) Filed: Jul. 24, 2013

(65) Prior Publication Data

US 2014/0056632 A1 Feb. 27, 2014

(30) Foreign Application Priority Data

Aug. 24, 2012 (JP) ..... 2012-185925
Apr. 12, 2013 (JP) ..... 2013-083660

(51) Int. Cl.

| | |
|---|---|
| ***B41J 11/70*** | (2006.01) |
| ***B41J 15/00*** | (2006.01) |
| ***B41J 11/66*** | (2006.01) |
| ***B41J 3/407*** | (2006.01) |
| ***B65C 11/02*** | (2006.01) |
| ***B65C 9/22*** | (2006.01) |

(Continued)

(52) U.S. Cl.

CPC ..... *B41J 11/66* (2013.01); *B41J 11/663* (2013.01); *B41J 3/4075* (2013.01); *B41J 11/703* (2013.01); *B65C 11/0226* (2013.01); *B65C 2210/0002* (2013.01); *B65C 2210/0064* (2013.01);

(Continued)

(58) Field of Classification Search

CPC .... B65C 9/0071; B65C 9/2256; B65C 9/226; B65C 9/2265; B41J 3/4075; B41J 11/663
USPC ..... 156/DIG. 34, DIG. 35; 427/286; 118/240, 241, 242, 243; 400/613, 88
See application file for complete search history.

(56) References Cited

U.S. PATENT DOCUMENTS 2,494,176 A * 1/1950 Howard ..... 118/33
2011/0277905 A1 11/2011 Koike

FOREIGN PATENT DOCUMENTS

JP 02-223461 A 9/1990
JP 05054225 U 7/1993

(Continued)

OTHER PUBLICATIONS

Japanese Office Action dated Aug. 19, 2014, issued in counterpart foreign Japanese Application No. 2013-083660.

(Continued)

*Primary Examiner* — Daniel J Colilla
(74) *Attorney, Agent, or Firm* — Holtz, Holtz, Goodman & Chick PC

(57) ABSTRACT

A printing device includes a driver rotating and driving a feeder roller feeding a printing target member, a printing section performing printing on the printing target member, a cutter cutting the printing target member, a transfer mechanism which is provided at an upstream side of the feeding direction of the printing target member over the printing section and which selectively causes a transfer member with an adhesive to be in contact with the printing target member while feeding the transfer member to transfer the adhesive, and a transfer controller controlling transfer/non-transfer. The transfer/non-transfer of the adhesive to the printing target member is controlled based on positive/reverse rotation of a motor, and a print tape with an adhesive on the whole surface, a partial adhesive or no adhesive at all and without a paper liner is freely creatable.

9 Claims, 10 Drawing Sheets

(52) U.S. Cl.
CPC ..... *B65C2210/007* (2013.01); *B65C 9/226* (2013.01); *B65C 9/2265* (2013.01)

(56) References Cited

FOREIGN PATENT DOCUMENTS

| | | | | | |
|---|---|---|---|---|---|
| JP | 06-312545 | A | | 11/1994 | |
| JP | 10244710 | A | | 9/1998 | |
| JP | 11334153 | A | * | 12/1999 | ..... B41J 3/36 |
| JP | 2009090497 | A | * | 4/2009 | ..... B41J 3/36 |
| JP | 2009154438 | A | | 7/2009 | |
| JP | 2011-235595 | A | | 11/2011 | |
| JP | 2012025165 | A | * | 2/2012 | ..... B41J 3/36 |

OTHER PUBLICATIONS

Japanese Office Action dated Jan. 20, 2015, issued in counterpart Japanese Application No. 2013-083660.

* cited by examiner

TAPE PRINTING DEVICE WITH ADHESIVE TRANSFER MECHANISM BEFORE PRINTING SECTION

CROSS-REFERENCE TO RELATED APPLICATION

This application claims the benefit of Japanese Patent Application No. 2012-185925, filed on Aug. 24, 2012 and Japanese Patent Application No. 2013-083660, filed on Apr. 12, 2013, the entire disclosure of which is incorporated by reference herein.

FIELD

This application relates generally to a printing device that is capable of freely creating, without a paper liner on the rear surface of a print tape, the print tape with a whole-surface adhesive, a partial adhesive or no adhesive at all together with a printing.

BACKGROUND

Conventionally, a printing device for creating an adhesive label with a paper liner is known which performs printing through a thermal head on a thermo-sensitive tape formed of a rolled thermal paper cut into a tape shape with a paper liner. When the paper liner is peeled after the printing, the adhesive label can be pasted.

Moreover, for example, Unexamined Japanese Patent Application Kokai Publication No. H02-223461 discloses a tape printing device which performs reverse printing on a transparent tape, bonds a bonding surface of a double-sided tape on the printed surface to create a printed tape (printed label) having the printed letters and the like protected. When the paper liner on the other bonding surface is peeled, such a printed label can be utilized as an adhesive label.

However, the paper liner that eventually becomes a waste material and a trash at a user's end after the tape is used is useless, and a manual work of peeling the paper liner is necessary, and thus there is a leeway for improving the usability.

Conversely, for example, Unexamined Japanese Patent Application Kokai Publication No. H06-312545 discloses a tape printing device for a liner-less tape which forms a sticking layer on one surface of a tape base material, forms a surface of a platen roller as a peeling surface that is likely to be peeled against the sticking layer of a print tape, performs printing on the opposite surface to the sticking layer of the tape base material to create a print tape, thereby excluding the use of a paper liner (liner) that eventually becomes a waste material.

The rolled tape used for the tape printing device disclosed in Unexamined Japanese Patent Application Kokai Publication No. H06-312545 needs to satisfy specifications that an adhesive is applied to the whole rear surface of a tape, a silicon layer mainly containing silicon is provided on the thermo-sensitive front surface, and such a tape is rolled up without a paper liner.

However, there are several requests for a print tape where no adhesive is necessary at all and the adhesive should be partially applied to the print tape since the print tape is to be used as a sticky note. Hence, the print tape having the adhesive layer on the whole rear surface of the print tape is not suitable for users who desire the above-explained applications.

Hence, Unexamined Japanese Patent Application Kokai Publication No. 2011-235595 discloses a method for creating a sticking label that is capable of cutting down the use of the adhesive by allowing a user to eliminate the adhesive in accordance with the printing purpose without a liner. That is, this patent publication discloses the use of an adhesive applying mechanism that applies an adhesive to a part of a recording medium passing through a cut position.

According to the method for creating a sticking label disclosed in Unexamined Japanese Patent Application Kokai Publication No. 2011-235595, however, it is suggested that the adhesive applying mechanism may be placed in a printer, but the adhesive applying mechanism basically has an adhesive transferring unit 1B with a depression mechanism 17 which is provided at the ejection port located at the downstream side of the cutter 4 of the printer 1A.

Hence, downsizing and practical structure of the main body of the printer have not been thoroughly studied, thus, there is still room for improvement. Moreover, an example is merely disclosed in which the adhesive to the recording medium is applied by repeating a depressed condition and a non-depressed condition alternately. Hence, there is no disclosure for an adhesive application control meeting various applications such that the adhesive should be partially applied like the above-explained sticky note.

SUMMARY

The present invention has been made in view of the above-explained circumstances, and it is an objective of the present invention to provide a printing device that is capable of freely creating, without a paper liner on the rear surface of a print tape, the print tape with a whole-surface adhesive, a partial adhesive or no adhesive at all together with a printing.

To accomplish the above object, an aspect of the present invention provides a printing device that includes: a feeder roller that feeds a printing target member; a driver that rotates and drives the feeder roller; a printing section that performs printing on the fed printing target member; a cutter that cuts the printing target member in a direction orthogonal to a feeding direction of the printing target member; a transfer mechanism which is provided at an upstream side of the feeding direction of the printing target member over the printing section and which selectively causes a transfer member with an adhesive to be in contact with the fed printing target member while feeding the transfer member to transfer the adhesive on a surface of the printing target member where no printing is performed; and a transfer controller that controls transfer/non-transfer of the adhesive to the surface where no printing is performed by the transfer mechanism.

In the above-explained printing device, the transfer mechanism may include a pair of transfer rollers which are capable of holding the printing target member and the transfer member between the transfer rollers and which come in contact with each other and come apart from each other via the printing target member and the transfer member.

In the above-explained printing device, the transfer member may include a tape-shaped mat and the adhesive applied on a surface of the tape-shaped mat, and may be wound between a feeding roller and a winding roller in such a way that another surface of the tape-shaped mat where no adhesive is applied contacts the one roller between the pair of the transfer rollers.

In the above-explained printing device, it is preferable that the adhesive should be applied in a direction orthogonal to a feeding direction of the tape-shaped mat with a predetermined interval in the feeding direction of the tape-shaped mat. Moreover, the adhesive may be applied in a dot manner or in a linear manner in a direction orthogonal to the feeding direction of the tape-shaped mat.

In the above-explained printing device, the transfer member may be retained in a cartridge together with the one roller of the pair of the transfer roller, the feeding roller, and the winding roller, the cartridge being freely detachable from the printing device. Moreover, the cartridge may be a plurality of cartridges prepared corresponding to a plurality of the transfer members having different adhesive forces of the applied adhesive.

In the above-explained printing device, the printing target member may be a thermo-sensitive tape, and the printing section may include a platen roller and a thermal head, and the platen roller may serve as the feeder roller.

As explained above, according to the present invention, it becomes possible to provide a printing device that is capable of freely creating, without a paper liner on the rear surface of a print tape, the print tape with a whole-surface adhesive, a partial adhesive or no adhesive at all together with a printing.

BRIEF DESCRIPTION OF THE DRAWINGS

A more complete understanding of this application can be obtained when the following detailed description is considered in conjunction with the following drawings, in which.

DETAILED DESCRIPTION

An explanation will be given of an embodiment of the present invention in detail with reference to the accompanying drawings.

First Embodiment

Figure 1A:
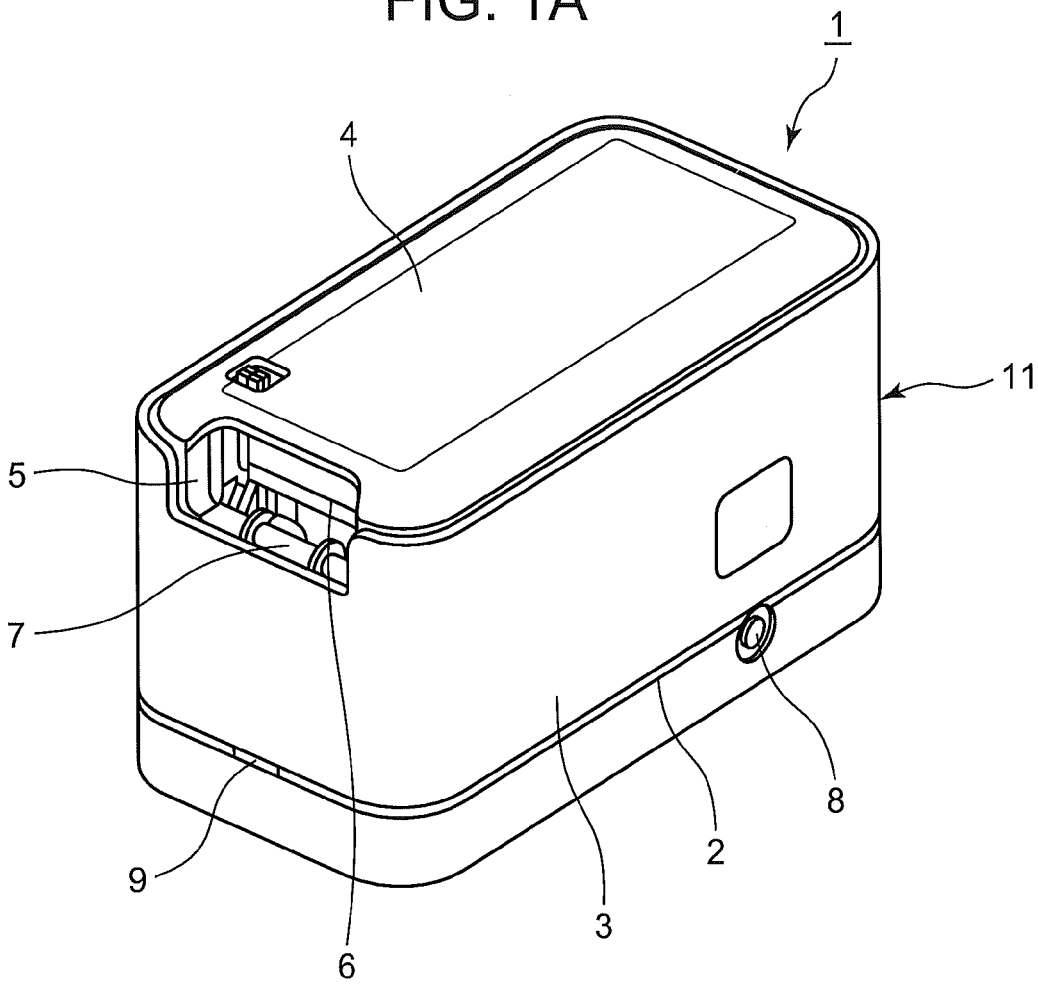
FIG. 1A is a perspective external view illustrating a printing device according to a first embodiment of the present invention.
Figure 1B:
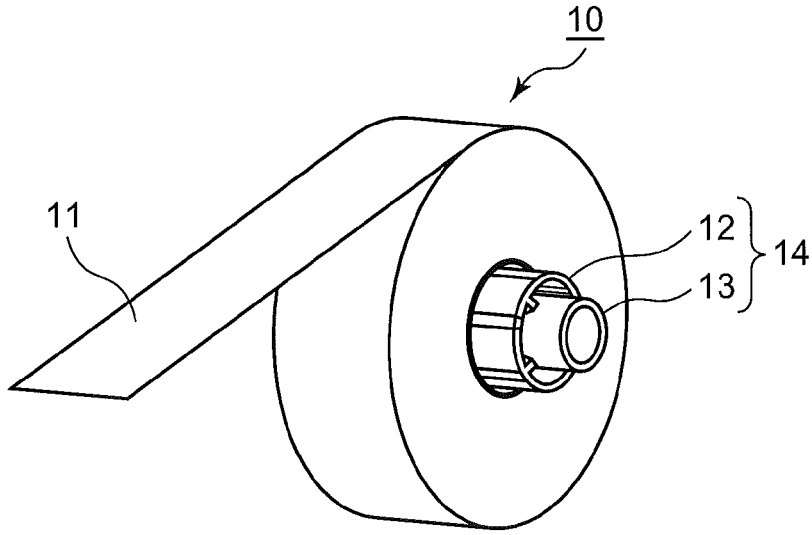
FIG. 1B is a diagram illustrating a rolled thermo-sensitive tape loaded in the printing device.

FIG. 1A is a perspective external view of a printing device according to a first embodiment of the present invention, and FIG. 1B is a diagram illustrating a rolled thermo-sensitive tape loaded in this printing device.

As illustrated in FIG. 1A, a printing device (hereinafter, also referred to as a device main body) 1 includes a main body casing 3 which is formed in a substantially rectangular shape and which has a decoration groove 2 formed in the outer circumferential surface near the bottom, and a freely openable/closable upper lid 4 provided on the upper opening of the main body casing 3.

The top part of the front surface of the main body casing 3 and the front part of the upper lid 4 are respectively cut out partially, and the two cutouts form an ejection port 5 for a tape having undergone a printing. A tape cutter 6 that cuts a tape having undergone a printing is disposed at the upper space near the internal space relative to the ejection port 5, and an ejecting roller 7 that ejects the cut tape from the ejection port 5 is disposed at the lower space that is a downstream side.

A plug jack 8 for a power plug is formed in the side face of the main body casing 3 below the decoration groove 2. A USB jack 9 to be connected with a signal-line USB (Universal Serial Bus) terminal of an external host device and is formed in the front face of the main body casing 3 at the same location as that of the decoration groove 2.

A printing target member 10 illustrated in FIG. 1B includes a thermo-sensitive tape 11 cut in an elongated tape shape and wound in a roll, and a roll holder 14 that includes a reel 12 inserted in the center of the rolled thermo-sensitive tape 11 and directly holding the thermo-sensitive tape 11, and a reel supporting shaft 13 that supports the reel 12 in a freely rotatable manner.

Figure 2:
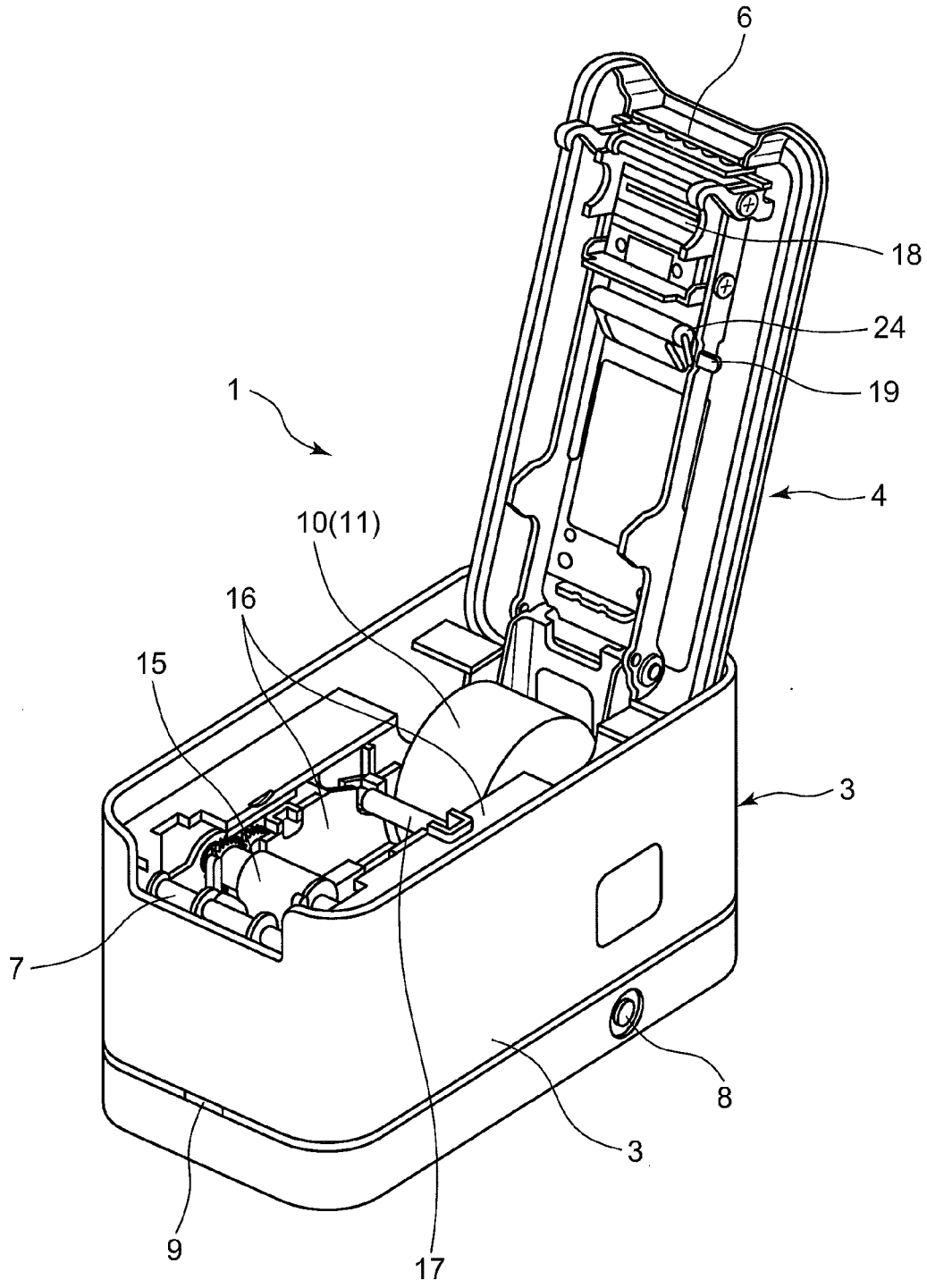
FIG. 2 is a perspective view illustrating the printing device of the first embodiment with an upper lid being rotated upwardly and backwardly and opened.

FIG. 2 is a perspective view illustrating the printing device 1 with the upper lid 4 being rotated upwardly and backwardly and opened. The same component in FIG. 2 as those of FIGS. 1A and 1B will be denoted by the same reference numeral as those of FIGS. 1A and 1B.

As illustrated in FIG. 2, a platen roller 15 is disposed inside the main body casing 3 of the printing device 1 in addition to the ejecting roller 7 and the rolled thermo-sensitive tape 11 of the printing target member 10 illustrated in FIGS. 1A and 1B. A cartridge 16 having a transfer member to be discussed later in detail built therein, and a transfer roller 17 are disposed between the platen roller 15 and the printing target member 10.

In FIG. 2, only the cartridge 16 and the transfer roller 17 are illustrated, and the illustration of the transfer member is omitted. In FIG. 2, moreover, a feeding roller and a winding roller in the cartridge 16 to be discussed later are hidden by other components.

As illustrated in FIG. 2, a thermal head 18 and a part of an adhesive transfer mechanism to be discussed later which transfers an adhesive are disposed on the internal face of the upper lid 4 of the printing device 1 in addition to the tape cutter 6 illustrated in FIG. 1A. In FIG. 2, a cam engager 19 of the adhesive transfer mechanism and a transfer roller 24 thereof are illustrated.

Figure 3A:
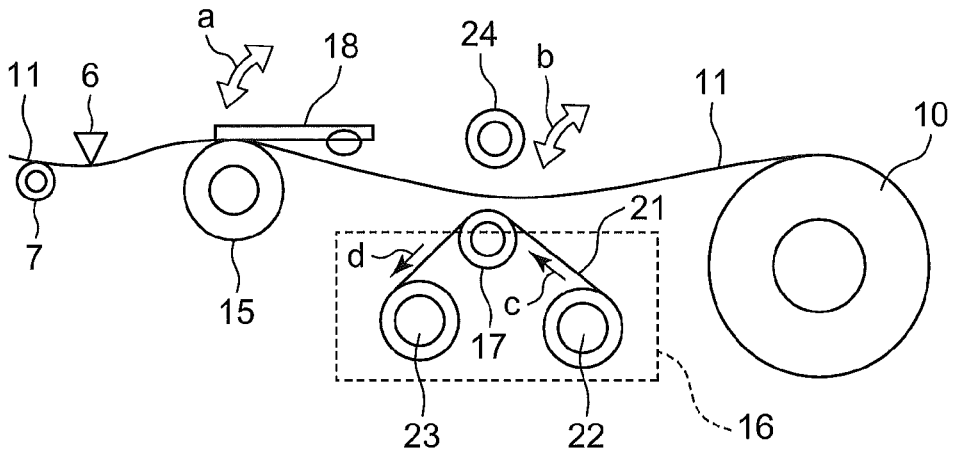
FIG. 3A is a diagram illustrating, in a simplified manner, an internal structure of a cartridge loaded between a platen roller of the printing device of the first embodiment and a printing target member in a freely detachable manner.
Figure 3B:
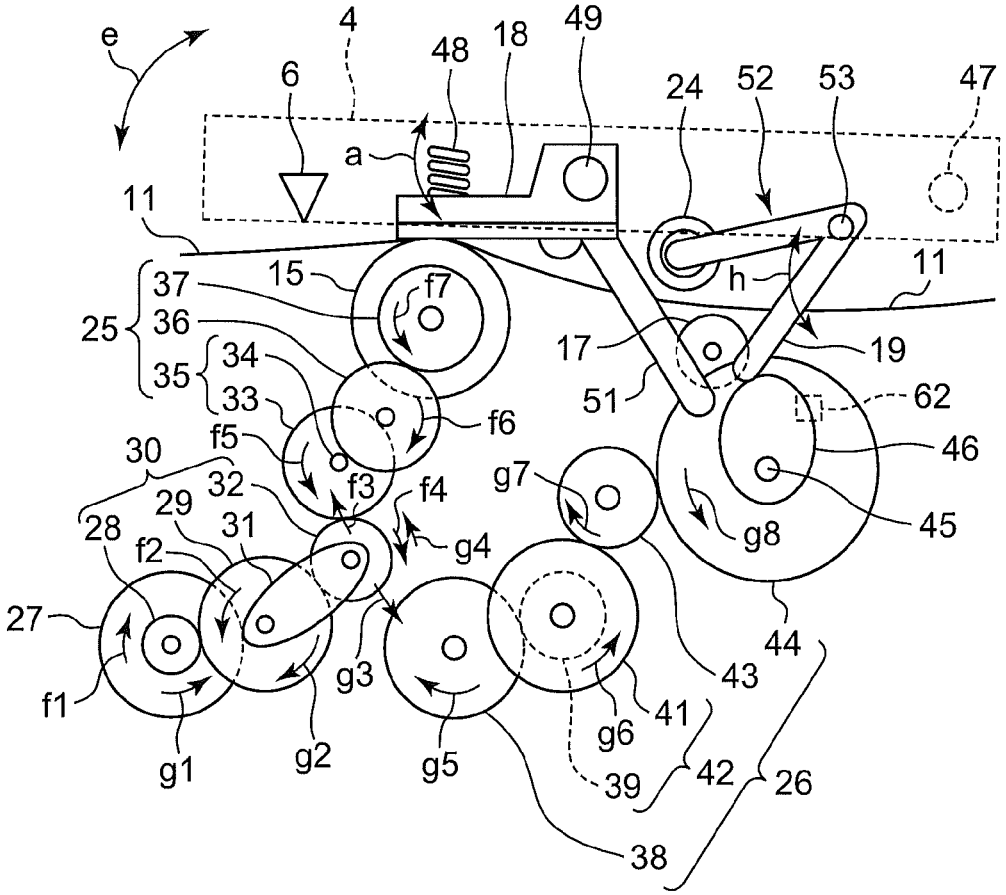
FIG. 3B is a diagram illustrating a structure of a gear sequence that changes a drive target between a thermal head and an adhesive transfer mechanism.

FIG. 3A is a diagram illustrating, in a simplified manner, an internal structure of the cartridge 16 loaded in a freely detachable manner between the platen roller 15 and the printing target member 10, and FIG. 3B is a diagram illustrating a structure of a gear sequence that changes a drive target between the thermal head 18 and the adhesive transfer mechanism.

The thermal head 18 includes a printing head provided at the leading end and including a heater element array although it is not particularly illustrated, the printing head rotates up and down as indicated by a bidirectional arrow a in FIGS. 3A and 3B so as to be apart from and to be in contact with the platen roller 15 via the thermo-sensitive tape 11.

This thermal head 18 contacts the platen roller 15 with pressure via the thermo-sensitive tape 11 as illustrated in FIGS. 3A and 3B at the time of printing, performs printing on the thermo-sensitive tape 11, and becomes distant from the platen roller 15 in the upward direction when no printing is performed.

As illustrated in FIG. 3A, the cartridge 16 is loaded between the platen roller 15 and the printing target member 10 and below the thermo-sensitive tape 11 rolled out from the printing target member 10 to the platen roller 15.

An adhesive tape 21 as a transfer member, a feeding roller 22 that feeds out the adhesive tape 21, and a winding roller 23 that winds up the adhesive tape 21 are retained in the cartridge 16 in addition to the transfer roller 17 illustrated in FIG. 2.

A transfer roller 24 at the device-main-body side which is a pair with the transfer roller 17 is disposed on the internal face of the upper lid 4 of the printing device 1 at a location facing with the transfer roller 17, and the pair of transfer rollers configure a transfer section of the adhesive transfer mechanism.

The transfer roller 24 at the device-main-body side rotates up and down in a direction indicated by a bidirectional arrow b by the gear sequence illustrated in FIG. 3B, and comes in contact with or becomes apart from the transfer roller 17 at the cartridge-16 side via the thermo-sensitive tape 11 and the adhesive tape 21.

When the transfer roller 24 moves in a direction in which the transfer roller 24 contacts the transfer roller 17, the pair of transfer roller 24 and transfer roller 17 work together to hold therebetween the thermo-sensitive tape 11 and the adhesive tape 21. Subsequently, a transfer of an adhesive to the non-printing surface, that is, the rear surface of the thermo-sensitive tape 11 is started.

At this time, as is indicated by an arrow c, the adhesive tape 21 is fed out from the feeding roller 22, and held between the transfer roller 24 and the transfer roller 17 via the rear surface of the thermo-sensitive tape 11. An adhesive is applied to a surface of the adhesive tape 21 contacting the rear surface of the thermo-sensitive tape 11, and is transferred to the rear surface of the thermo-sensitive tape 11.

The adhesive tape 21 having the adhesive transferred to the rear surface of the thermo-sensitive tape 11 and becoming as used is wound by the winding roller 23 as is indicated by an arrow d.

The gear sequence that changes the drive target between the thermal head 18 and the adhesive transfer mechanism illustrated in FIG. 3B is divided into a feeding gear sequence 25 and a cam gear sequence 26. Those gear sequences are changed and driven by a planet gear group 30 including a motor shaft pinion 28 of a stepping motor 27, an intermediate gear 29, and a planet gear 32 attached to a rotation arm 31 together with the intermediate gear 29.

The one feeding gear sequence 25 includes two gears 35 configured by a larger-diameter gear 33 and a smaller-diameter gear 34, an idler gear 36 meshed with the smaller-diameter gear 34 of the two gears 35, and a platen gear 37 meshed with the idler gear 36. The platen gear 37 is coupled with the platen roller 15 in a coaxial manner therewith.

The other cam gear sequence 26 includes a drive transmission gear 38, two gears 42 including a smaller-diameter gear 39 meshed with the drive transmission gear 38, and a larger-diameter gear 41 integral with the smaller-diameter gear 39, an idler gear 43 meshed with the larger-diameter gear 41 of the two gears 42, and a cam gear 44 meshed with the idler gear 43. The lower end of an elliptical cam 46 in the lengthwise direction is fastened to a rotation shaft 45 of the cam gear 44.

When the stepping motor 27 that drives the planet gear group 30 rotates in the clockwise direction indicated by an arrow f1, the intermediate gear 29 rotates in the counterclockwise direction indicated by an arrow f2. The rotation arm 31 has the rotation pivot point of the lower end coupled with the rotation shaft of the intermediate gear 29 through a clutch, and rotates in the counterclockwise direction indicated by an arrow f3 until the planet gear 32 at the rotation end abuts the larger-diameter gear 33 of the two gears 35 and is meshed therewith.

The planet gear 32 is rotated and driven by the intermediate gear 29 in the direction indicated by an arrow f4, and this rotation is transmitted to the larger-diameter gear 33 of the two gears 35. Accordingly, the two gears 35 rotate in the counterclockwise direction indicated by an arrow f5, and this rotation is transmitted to the idler gear 36 through the smaller-diameter gear 34 of the two gears 35.

The idler gear 36 rotates in the clockwise direction indicated by an arrow f6, and this rotation is transmitted to the platen gear 37 as a rotation in the counterclockwise direction indicated by an arrow f7. Hence, the platen roller 15 rotates in the counterclockwise direction, that is, the direction of feeding the thermo-sensitive tape 11. In this manner, the platen roller 15 also serves as a feeder roller.

When the stepping motor 27 that drives the planet gear group 30 rotates in the counterclockwise direction indicated by an arrow g1, the intermediate gear 29 rotates in the clockwise direction indicated by an arrow g2. The rotation arm 31 rotates in the clockwise direction indicated by an arrow g3 with the rotation pivot point of the lower end being as a pivot point until the planet gear 32 at the rotation end abuts the drive transmission gear 38 and is meshed therewith.

The planet gear 32 is rotated and driven in the counterclockwise direction indicated by an arrow g4 by the intermediate gear 29, and this rotation is transmitted to the drive transmission gear 38. Hence, the drive transmission gear 38 rotates in the clockwise direction indicated by an arrow g5, and this rotation is transmitted to the smaller-diameter gear 39 of the two gears 42.

The two gears 42 rotate in the counterclockwise direction indicated by an arrow g6, and this rotation is transmitted to the idler gear 43 through the larger-diameter gear 41 of the two gears 42. The idler gear 43 rotates in the clockwise direction indicated by an arrow g7, and this rotation is transmitted to the cam gear 44.

The cam gear 44 rotates in the counterclockwise direction indicated by an arrow g8 at an angle in accordance with the stepping of the stepping motor 27 in the reverse rotation. This rotation advances intermittently and sequentially. That is, the elliptical cam 46 rotates intermittently and sequentially in the counterclockwise direction indicated by the arrow g8.

The thermal head 18 rotated and driven by those planet gear group 30, feeding gear sequence 25, and cam gear sequence 26 and the other transfer roller 24 of the adhesive transfer mechanism facing with the transfer roller 17 at the cartridge-16 side are disposed on the rear face of the upper lid 4. The upper lid 4 rotates up and down indicated by an bidirectional arrow e with a hinge 47 being as a pivot point between an opened condition illustrated in FIG. 2 and a closed condition illustrated in FIG. 3B.

FIG. 3B illustrates a printing position in which the thermal head 18 depresses the thermo-sensitive tape 11 to the platen roller 15 by the pushing force by a helical spring 48 having depressing pushing force with the upper lid 4 being closed.

The thermal head 18 has a rotation end where the heater element array is disposed rotating up and down indicated by the bidirectional arrow a illustrated in FIG. 3A with a supporting shaft 49 being as a pivot point. A bar-shaped cam engaging member 51 protrudes from the supporting shaft 49 in an oblique downward direction.

In FIG. 3B, the elliptical cam 46 stands still in the vertical direction, and in this condition, the lower end of the bar-shaped cam engaging member 51 is disengaged with the elliptical cam 46 contacting therewith in a sliding manner. Hence, the thermal head 18 is in a printing position in which such a head depresses the thermo-sensitive tape 11 to the platen roller 15 by the pushing force by the helical spring 48.

Conversely, in FIG. 3B, the transfer roller 24 of the adhesive transfer mechanism at the upper-lid-4 side is held at the upper end of a cam engaging member 52 in the reversed V-shape. The reverse V-shaped cam engaging member 52 has the center bent portion supported by a supporting shaft 53 fastened to the upper lid 4 in a freely rotatable manner in the vertical direction indicated by a bidirectional arrow h, and is always pushed in the counterclockwise direction by an unillustrated pushing member.

The lower portion below the center vent portion supported by the supporting shaft 53 forms a cam engaging member 19 also illustrated in FIG. 2. In FIG. 3B, the elliptical cam 46 stands still in the vertical direction, and in this condition, the lower end of the reverse V-shaped cam engaging member 52, that is, the lower end of the cam engaging member 19 contacts the circumferential surface of the elliptical cam 46 most distant from the supporting shaft 45 in a slidable manner.

In this condition, the reverse V-shaped cam engaging member 52 is rotated and pushed by the elliptical cam 46 in the upward direction with the supporting shaft 53 being as a pivot point against the pushing force by the unillustrated pushing member. Hence, the transfer roller 24 at the upper end of the reverse V-shaped cam engaging member 52 becomes apart from the transfer roller 17 at the cartridge-16 side, and thus the adhesive transfer mechanism maintains a non-transferring condition of the adhesive. This non-transferring condition of the adhesive will be referred to as "adhesive transfer OFF" or simply "transfer OFF".

Although not particularly illustrated in the figure, but it is presumed that the stepping motor 27 rotates in the reverse direction by the predetermined number of steps from the condition illustrated in FIG. 3B, and the cam gear 44, that is, the elliptical cam 46 rotates by a predetermined angle in the direction indicated by an arrow g8.

According to this reverse rotation, the lower end of the cam engaging member 19 of the transfer roller 24 contacts in a sliding manner the circumferential surface of the elliptical cam 46 most distant from the supporting shaft 45 but at the opposite side to FIG. 3B, and the adhesive transfer mechanism maintains the adhesive transfer OFF condition.

Conversely, the lower end of the bar-shaped cam engaging member 51 of the thermal head 18 contacts in a sliding manner the circumferential surface of the elliptical cam 46 with which the lower end of the cam engaging member 19 had contacted so far and which is most distant from the supporting shaft 45, and is pushed out to the left. Accordingly, the thermal head 18 rotates upwardly, becomes distant from the platen roller 15, and becomes a standby condition at a non-printing position. This condition will be referred to as "head UP".

The position of the elliptical cam 46 at this time is an initial position, that is, a home position. This position is detected by a home position sensor 62 (hereinafter, simply referred to as a home sensor), and the elliptical cam 46 is positioned to the home position. With the home position being as a base point, the stepping motor 27 intermittently rotates by, for example, A steps, and B steps, and in accordance with the rotation, the elliptical cam 46 intermittently rotates in the direction indicated by the arrow g8.

In the intermittent rotation position by the first A steps, the lower end of the bar-shaped cam engaging member 51 of the thermal head 18 is disengaged from the sliding contact with the elliptical cam 46, and the thermal head 18 rotates downwardly. The printing head at the leading end contacts the platen roller 15 with pressure via the thermo-sensitive tape 11, and the thermal head 18 becomes the same condition as the one illustrated in FIG. 3B. This condition will be referred to as "head Down".

At the first intermittent rotation position of the elliptical cam 46, the lower end of the cam engaging member 19 of the transfer roller 24 contacts in a sliding manner the intermediate circumferential surface of the elliptical cam 46 between the location most distant from the supporting shaft 45 and the closest position therefrom. Hence, the transfer roller 24 rotates and moved downwardly, but does not contact the transfer roller 17 with pressure yet, and the adhesive transfer mechanism is still in the adhesive transfer OFF condition.

In the intermittent rotation position by the next B steps, the rotation end of the elliptical cam 46 in the lengthwise direction, that is, the circumferential surface most distant from the rotation shaft 45 rotates up to the position substantially right below the rotation shaft 45, and thus both lower end of the bar-shaped cam engaging member 51 of the thermal head 18 and lower end of the cam engaging member 19 of the transfer roller 24 become a disengaged condition from the engagement with the elliptical cam 46.

Accordingly, the thermal head 18 supports the head Down condition, and the transfer roller 24 further rotates and moved downwardly, holds the thermo-sensitive tape 11 and the adhesive tape 21 together with the transfer roller 17, and contacts therewith with pressure. The condition that enables a transfer of the adhesive will be referred to as "adhesive transfer ON" or simply "transfer ON".

Figure 4:
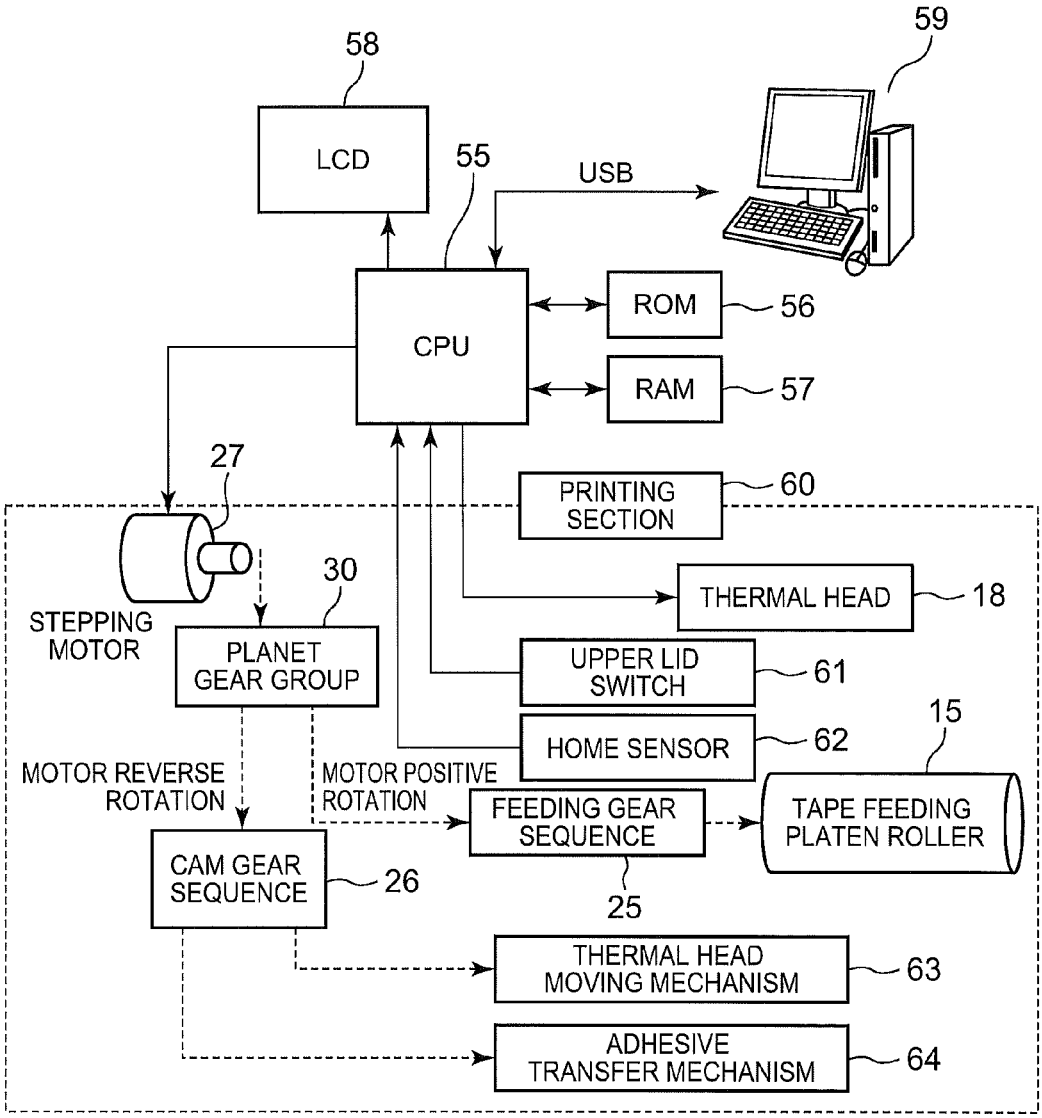
FIG. 4 is a block diagram illustrating a controller of the printing device of the first embodiment.

FIG. 4 is a block diagram illustrating the controller of the printing device 1 employing the above-explained structure and operating as explained above. As illustrated in FIG. 4, the controller includes a CPU (Central Processing Unit) 55. The CPU 55 is coupled with a ROM (Read Only Memory) 56 and a RAM (Random Access Memory) 57.

Furthermore, the CPU 55 is coupled with an LCD (Liquid Crystal Display) 58 to which the CPU 55 outputs display signals. Moreover, the stepping motor 27 to which the CPU 55 outputs positive/reverse rotation pulse signals and the thermal head 18 that outputs print data signals are coupled between the CPU 55 and a printing section 60.

Open/close signals of the upper lid 4 output by an upper lid switch 61 that detects opening/closing of the upper lid 4 and ON/OFF signals output by the home sensor 62 of a home position detection indicating whether or not the elliptical cam 46 reaches the home position are output from the printing section 60 to the CPU 55.

In addition to the above-explained components, the planet gear group 30, the cam gear sequence 26, and the feeding gear sequence 25 illustrated in FIG. 3B are collectively illustrated in a block in the printing section 60. As explained together with FIG. 3B, the feeding gear sequence 25 rotates and drives the platen roller 15 that also serves for the feeding of the tape.

Moreover, the cam gear sequence 26 drives a thermal head moving mechanism 63 and an adhesive transfer mechanism 64. The thermal head moving mechanism 63 includes the elliptical cam 46, the bar-shaped cam engaging member 51, the helical spring 48, and the like illustrated in FIG. 3B.

An explanation will be a whole structure of the adhesive transfer mechanism 64. The adhesive transfer mechanism 64 includes the cartridge 16 that supplies an adhesive, the transfer roller 24 at the upper-lid-4 side located at a position facing with the transfer roller 17 of the cartridge 16, the reverse V-shaped cam engaging member 52, the elliptical cam 46, and the like.

In the following explanation, the term "adhesive transfer mechanism 64" indicates an adhesive transfer section including, in particular, the transfer roller 17 and the transfer roller 24 among the above-explained structure. The operation is set by operations of the whole structure of the above-explained adhesive transfer mechanism, the cam gear sequence 26, the planet gear group 30, the stepping motor 27, and the like.

In FIG. 4, the CPU 55 is coupled with an external personal computer (hereinafter, referred to as a PC) 59 or the like through the USB jack 9 illustrated in FIG. 1A, and print data created over an application of the PC 59 is transmitted to the CPU 55.

The CPU 55 extracts the print data received from the PC 59 in a printing buffer placed in a predetermined area of the RAM 57, transmits the pulse signals to the stepping motor 27, while at the same time, transfers the print data to the thermal head 18 in accordance with a tape feeding pitch by the stepping motor 27 based on the extracted print data, and causes the heater element array to generate heat, thereby printing the print data on the thermo-sensitive tape 11.

A feature of this example is, in addition to the printing of the print data on the thermo-sensitive tape 11 by the thermal head 18, the adhesive transfer mechanism 64 which is explained with reference to FIGS. 3A and 3B and which transfers the adhesive on the adhesive tape 21 on the rear surface of the thermo-sensitive tape 11.

As is explained together with FIGS. 3A and 3B, first, the adhesive transfer mechanism 64 includes the planet gear group 30 provided between the stepping motor 27 that is a drive source of the platen roller 15 feeding the thermo-sensitive tape 11 and the feeding gear sequence 25.

Next, when the stepping motor 27 rotates in the reverse direction, the drive transmission to the platen roller 15 is cut, and the cam gear sequence 26 is rotated which changes the adhesive transfer ON/OFF of the adhesive transfer mechanism 64 to cause the adhesive tape 21 and the thermo-sensitive tape 11 to be in contact with each other with pressure, thereby transferring the adhesive on the rear surface of the thermo-sensitive tape 11.

Figure 5:
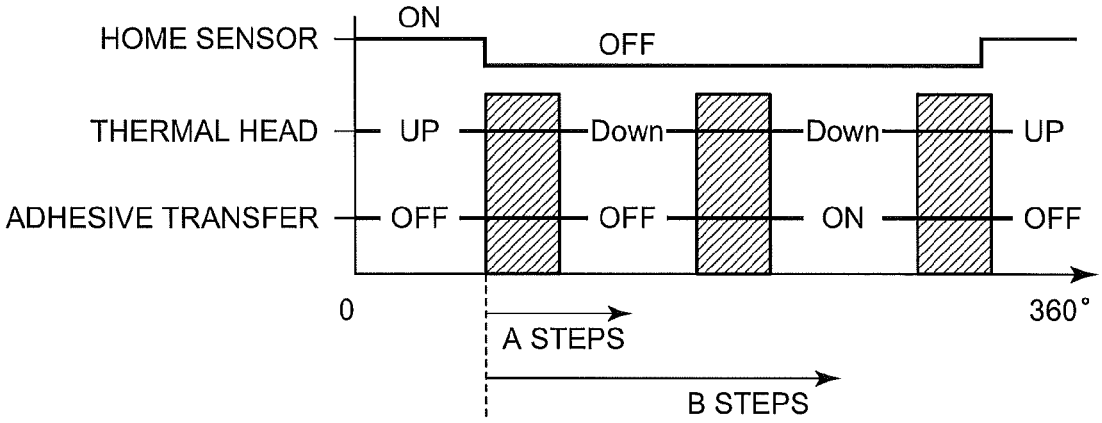
FIG. 5 is a timing chart illustrating operations of a home sensor and a thermal head, and a change in an adhesive transferring condition of an adhesive transfer mechanism of the printing device of the first embodiment.

FIG. 5 is a timing chart illustrating operations of the home sensor 62 and the thermal head 18, and a change in an adhesive transferring condition of the adhesive transfer mechanism 64. The horizontal axis indicates a rotation angle of the elliptical cam 46.

In the initial condition in which the rotation angle is "0", as explained with reference to FIG. 3B, the elliptical cam 46 is in the home position that is a position slightly rotated in the counterclockwise direction indicated by the arrow g8 from the position illustrated in FIG. 3B. Since the elliptical cam 46 is in the home position, the home sensor 62 is ON. Moreover, the head condition is head UP (non-printing) and adhesive transfer condition is adhesive transfer OFF (non-transferring).

When the stepping motor 27 reversely rotates by the A steps from those conditions, the elliptical cam 46 is out of the home position, and thus the home sensor 62 becomes OFF. The home sensor 62 maintains the OFF condition until the elliptical cam 46 rotates by 360 degrees from the initial position and returns to the home position.

Conversely, when the stepping motor 27 reversely rotates by the A steps as explained above, as is explained with reference to FIG. 3B, the head condition becomes head Down (printing condition) and the adhesive transfer OFF (non-transferring) condition is maintained.

In this condition, when the stepping motor 27 further rotates by the B steps from the position of the initial condition, as is explained with reference to FIG. 3B, the head Down (printing) condition is maintained, but the adhesive transfer condition is changed to the ON (transferring) condition.

Next, when the stepping motor 27 further reversely rotates and returns to the initial position rotated by 360 degrees from the initial position, that is, the home position, the home sensor 62 becomes ON, the head condition becomes head UP (non-printing), and the adhesive transfer condition becomes adhesive transfer OFF (non-transferring).

According to the printing device 1 of this embodiment, it is needless to say that a printing process without a transfer of the adhesive is possible, but the following explanation will be mainly given of a case in which a transfer of the adhesive is carried out.

Figure 6A:
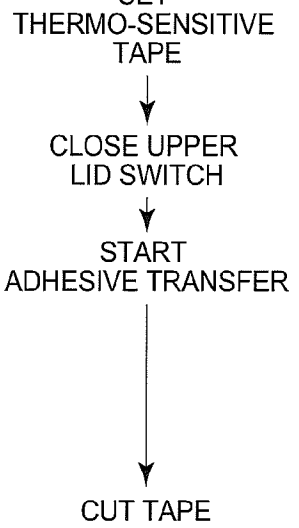
FIG. 6A is a flowchart for explaining an operation condition of the printing device in an initial setting of an adhesive transfer.
Figure 6B:
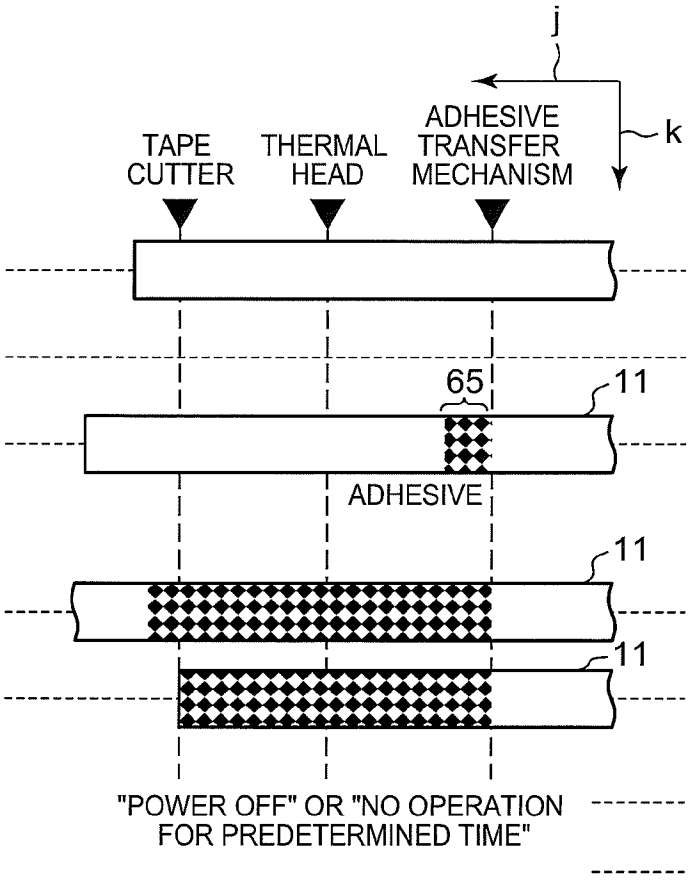
FIG. 6B is a diagram illustrating an operation condition of a thermo-sensitive tape.

FIG. 6A is a flowchart for explaining an operation condition in the initial setting of an adhesive transfer by the printing device 1 of this embodiment. FIG. 6B is a diagram illustrating a positional relationship among the tape cutter 6, the thermal head 18, and the adhesive transfer mechanism 64 in the operation condition illustrated in FIG. 6A, and how the adhesive is transferred on the rear surface of the thermo-sensitive tape 11.

Figure 6C:
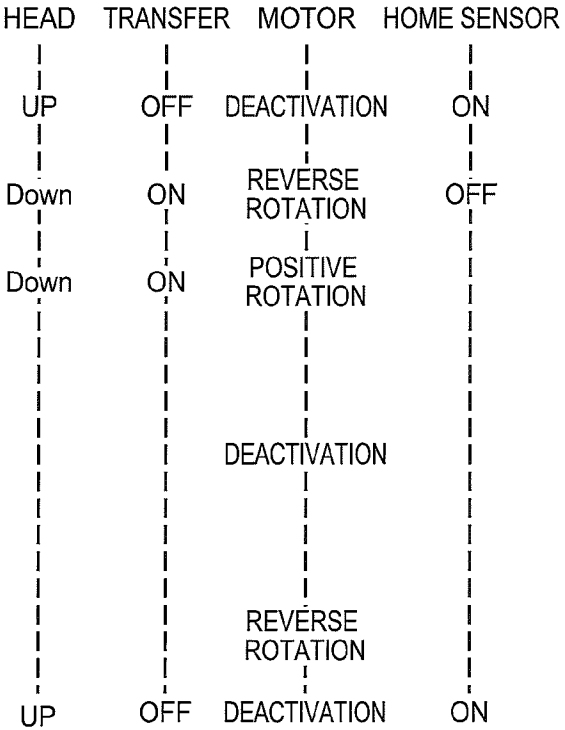
FIG. 6C is a diagram illustrating head UP/DOWN conditions, transfer ON/OFF conditions, motor deactivation/rotation/reverse rotation conditions, and home sensor ON/OFF conditions.

FIG. 6C is a diagram illustrating timings of head UP/Down of the thermal head 18, adhesive transfer ON/OFF of the adhesive transfer mechanism 64, deactivation/rotation/reverse rotation of the stepping motor 27, and ON/OFF of the home sensor in the operation condition illustrated in FIG. 6A.

An arrow j in FIG. 6B indicates a feeding direction of the thermo-sensitive tape 11, and an arrow k indicates an advancement in time. In the following explanation, adhesive transfer ON/OFF will be referred to as transfer ON/OFF, the thermal head 18 will be simply referred to as a head, and the stepping motor 27 will be simply referred to as a motor. The following processes are executed by the CPU 55.

In FIGS. 6A and 6B, first, the printing target member 10 illustrated in FIG. 1B is loaded in the printing device 1, the leading end of the thermo-sensitive tape 11 is drawn to the ejection port 5, and the thermo-sensitive tape 11 is set to be a condition ready for printing. At this time, as illustrated in FIG. 6C (and also FIG. 5), the head condition is UP, the transfer condition is OFF, the motor condition is deactivation, and the home sensor condition is ON.

Next, when the user closes the upper lid 4, the upper lid switch 61 detects that the upper lid 4 is closed, and notifies the CPU 55 of the detection result. Upon reception of the notification, the CPU 55 causes the motor to reversely rotate as illustrated in FIG. 6C.

When the motor reversely rotates by B steps from the initial condition, that is, the home position, as is explained with reference to FIG. 5 (and also FIGS. 3A and 3B), the elliptical cam 46 rotates by a predetermined angle from the home position in the direction of the arrow g8. The home sensor condition becomes OFF, the bar-shaped cam engaging member 51 and the reverse V-shaped cam engaging member 52 are disengaged from the elliptical cam 46, and thus the head condition becomes Down and the transfer condition becomes ON.

As illustrated in FIG. 6A, a transfer of the adhesive starts. FIG. 6B illustrates a condition right after the transfer of an adhesive 65 by the adhesive transfer mechanism 64. At this time, the conditions of home sensor OFF, the transfer ON, and the head Down are maintained, and the motor rotates in the positive direction.

The positive rotation of the motor causes the platen roller 15 to rotate, the thermo-sensitive tape 11 is fed, and the transfer of the adhesive is continued. In this initial setting stage, however, the head condition is Down but no heater element is driven to generate heat, and no transfer is performed.

When the transfer of the adhesive advances, and as illustrated in FIG. 6B, the leading end of the thermo-sensitive tape 11 having the adhesive transferred on the rear surface slightly runs over the position of the tape cutter, the motor is deactivated, as illustrated in FIG. 6C, and the feeding of the thermo-sensitive tape 11 is terminated. The feeding position of the thermo-sensitive tape 11 is recognized by the CPU 55 that counts the drive pulses (the number of rotation steps) of the motor.

In this condition, as illustrated in FIG. 6A, the thermo-sensitive tape 11 is cut by the tape cutter 6. Hence, the leading end of the thermo-sensitive tape 11 having no adhesive transferred thereon is cut and removed, and as illustrated in FIG. 6B, the thermo-sensitive tape 11 having the adhesive transferred within a range passing through the thermal head from the adhesive transfer mechanism to the tape cutter is set.

In this condition, when the power is turned OFF or no operation is given by the user for a predetermined time, as illustrated in FIG. 6C, the motor reversely rotates to drive the cam gear sequence 26, the head condition becomes UP (non-printing) and the transfer condition becomes OFF (non-transferring) when the home sensor condition becomes ON, and the motor is deactivated.

In order to facilitate understanding, the width of the thermo-sensitive tape 11 is made thin in FIGS. 6A, 6B and 6C, but the width of the thermo-sensitive tape 11 can be from substantially 10 mm to 60 mm, that is, the user can freely select the printing target member 10 within a range of typical widths of sticky notes like Post-it (registered trademark) and set the selected printing target member 10 in the printing device 1.

Moreover, the pitch from the adhesive transfer mechanism to the tape cutter passing through the thermal head is likewise made wide in the figures, but the actual distance from the adhesive transfer mechanism to the tape cutter is substantially 20 mm.

Figure 7A:
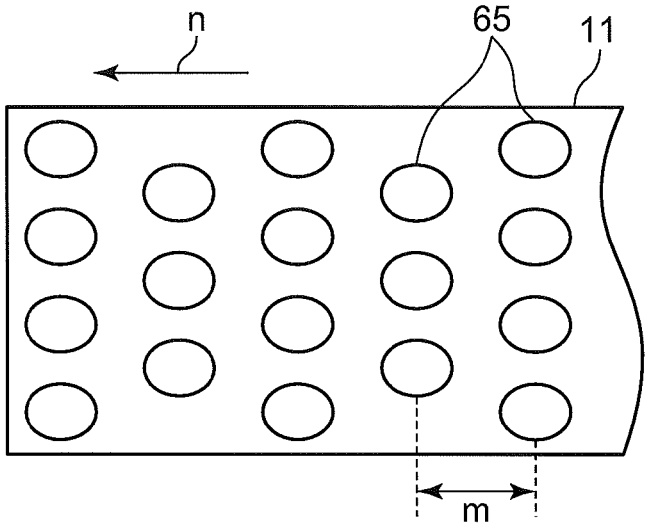
FIG. 7A is a plan view illustrating how the printing device transfers an adhesive to the rear surface of a thermo-sensitive tape.
Figure 7B:
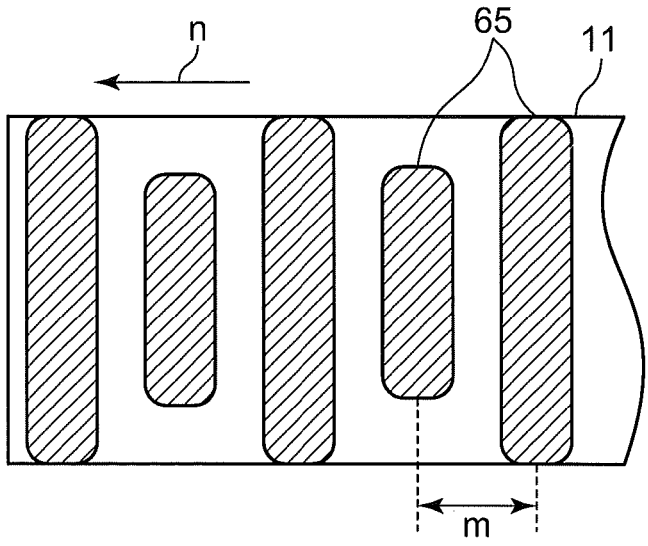
FIG. 7B is a plan view illustrating how the printing device transfers an adhesive to the rear surface of a thermo-sensitive tape.
Figure 7C:
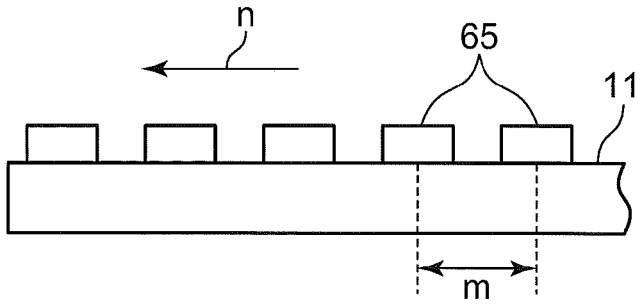
FIG. 7C is a side view of FIGS. 7A and 7B.

FIGS. 7A and 7B are diagrams illustrating the shape of the adhesive 65 applied to the adhesive tape 21 in a transferable manner which is a feature of the present invention. In other words, those figures are plan views illustrating how the adhesive 65 is transferred on the rear surface of the thermo-sensitive tape 11. FIG. 7C is a side view thereof.

As illustrated in FIGS. 7A and 7B, the adhesive 65 utilized in the present invention is not applied to the adhesive tape 21 in a solid manner, but is applied in the direction orthogonal to the feeding direction of a tape-shaped mat indicated by an arrow n with a predetermined interval m in the feeding direction of the tape-shaped mat.

Next, the adhesive 65 to be applied in the direction orthogonal to the feeding direction n of the tape-shaped mat has been applied in a dot manner as illustrated in FIG. 7A or is applied in a linear manner as illustrated in FIG. 7B. The adhesive in this condition is directly transferred on the rear surface of the thermo-sensitive tape 11.

The reason why the adhesive 65 is transferred on the rear surface of the thermo-sensitive tape 11 with the interval m in the feeding direction n is that the blade edge of the tape cutter is to be positioned between a piece of the adhesive 65 and another piece of the adhesive 65 when the thermo-sensitive tape 11 is cut by the tape cutter, thereby facilitating a clean cutting of the thermo-sensitive tape 11.

If the blade edge of the tape cutter is located right above the adhesive 65, the adhesive 65 can be easily split by the blade edge of the tape cutter since the adhesive 65 is transferred not in a solid manner but in a manner having an interval between pieces of the adhesive 65. Hence, the easiness of cutting remains the same also in this case.

The cutting by the tape cutter may be controlled in such a way that the cutting is carried out at a timing at which the blade edge of the tape cutter just enters between a piece of the adhesive 65 near the location where the thermo-sensitive tape 11 is cut and another piece of the adhesive 65.

Figure 8A:
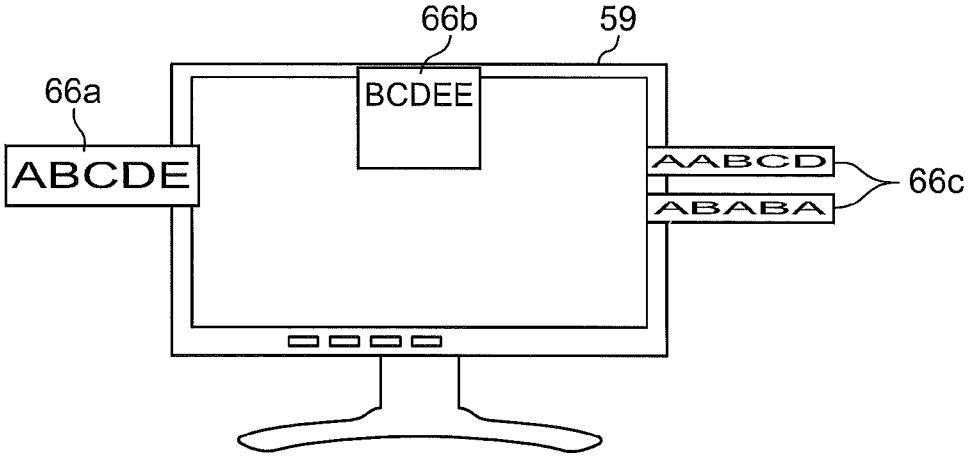
FIG. 8A is a diagram illustrating several examples of how to use labels which are created by the printing device of the first embodiment and which are formed of a thermo-sensitive tape having an adhesive transferred on a part (leading end) of the rear surface, having the front surface subjected to a printing, and cut by a predetermined length.
Figure 8B:
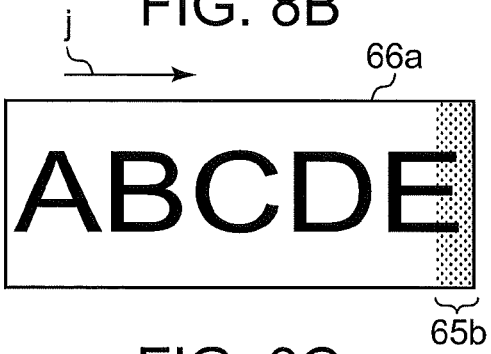
FIG. 8B is an enlarged view of each label illustrated in FIG. 8A.
Figure 8C:
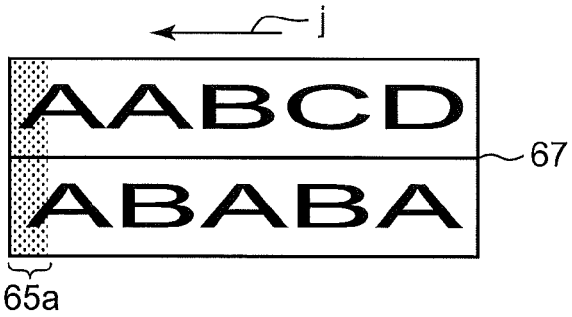
FIG. 8C is an enlarged view of each label illustrated in FIG. 8A.
Figure 8D:
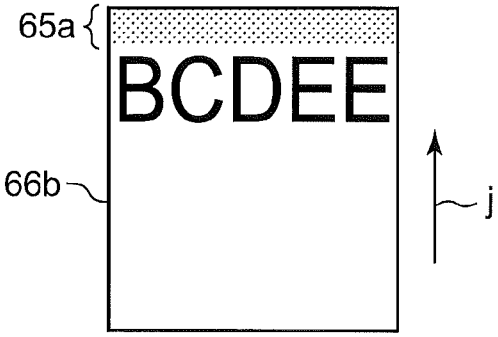
FIG. 8D is an enlarged view of each label illustrated in FIG. 8A.

FIG. 8A is a diagram illustrating several examples of how to use labels created by the printing device 1 of this embodiment and formed of the thermo-sensitive tape 11 having the adhesive 65 transferred on a part (leading end) of the rear surface, also having undergone a printing on the front surface, and cut by a predetermined length. FIGS. 8B, 8C, and 8D are enlarged views of those labels.

FIG. 8A illustrates an example case in which the user or the like using the PC 59 connects the printing device 1 with the PC 59 via a USB, creates labels 66 (66*a*, 66*b*, and 66*c*) using a label creating application on the PC 59, and pastes around the periphery of the PC 59 in such a way that the user or the like can pay attention thereto.

The label 66*a* is pasted on the left end edge of the PC 59 so as not to overlap with the display screen thereof. As illustrated in FIG. 8B, the label 66*a* has the adhesive 65 transferred on the leading end of the rear surface in the tape feeding direction indicated by an arrow j, but it is necessary that the adhesive applied part is the left end of the label, and thus the printing on the label is performed from the front end in the tape feeding direction to the rear end therein, and from the last of the texts to the head thereof.

Moreover, the label 66*b* is printed with the most important matter that must be completed by the user operating the PC 59 within a day, and thus the label 66*b* is pasted on the center location intentionally overlapping with the display screen of the PC 59.

As illustrated in FIG. 8D, this label 66*b* has the adhesive 65 transferred on the leading end of the rear surface in the tape feeding direction indicated by the arrow j. Since it is necessary that the adhesive applied part is the upper end of the label, the printing on the label is performed from the front end in the tape feeding direction to the rear end therein in such a way that the texts in the main scanning direction is successively moved in the sub scanning directions.

Furthermore, the two labels 66*c* are used and pasted on the right end edge of the PC 59 so as not to overlap with the display screen. As illustrated in FIG. 8C, the two labels 66*c* have the adhesive 65 transferred on the leading end of the rear surface of the wide thermo-sensitive tape 11 fed in the direction of the arrow j.

It is necessary that the two labels 66*c* have the adhesive applied portions that will be the left ends of the labels, and thus the printing on the labels are performed from the front end in the tape feeding direction to the rear end therein in such a way that the texts are in parallel with the sub scanning directions. The two labels 66*c* are obtained by cutting a piece of the label 66*c* illustrated in FIG. 8C by a scissors or the like along a cut line 67.

The labels 66*a*, 66*b*, and 66*c* illustrated in FIGS. 8B, 8C, and 8D have different directions of the texts arranged relative to the tape feeding direction, but such a printing can be easily realized by allowing the label creating application installed in the PC 59 to extract the texts in a bitmap memory in the positive direction, and by setting from which direction and how the extracted texts are forwarded to a shift memory to drive the thermal head 18.

An explanation will now be given of an operation in a transferring and applying process of the adhesive 65 to only the leading end of the rear surface of the print surface of the thermo-sensitive tape 11 in the feeding direction as explained above.

Figures 9A, 9B, 9C:
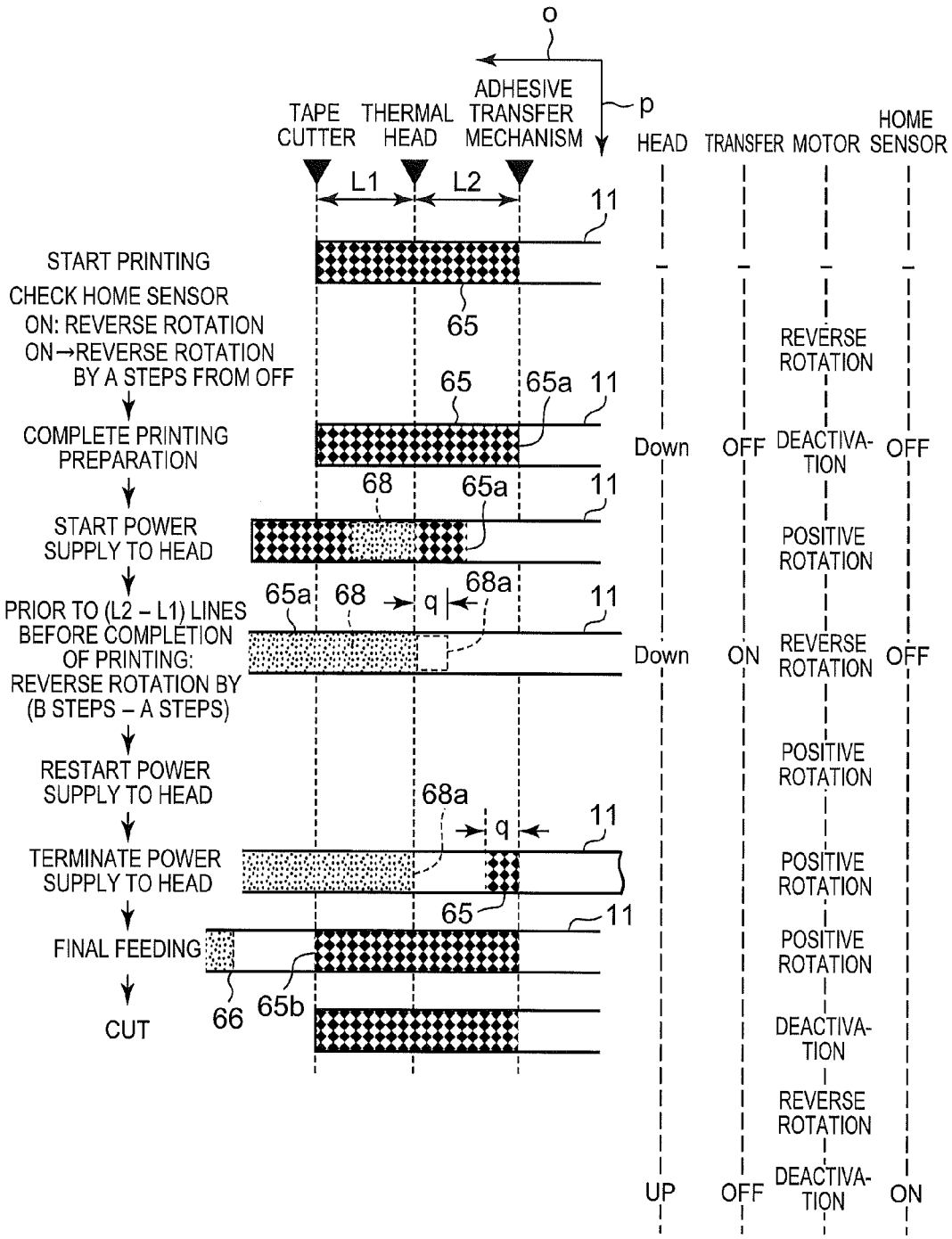
FIG. 9A is a flowchart for explaining a process executed by the printing device to transfer an adhesive to only the leading end of a thermo-sensitive tape.
FIG. 9B is a diagram illustrating an operation condition of the thermo-sensitive tape.
FIG. 9C is a diagram illustrating head UP/DOWN conditions, transfer ON/OFF conditions, motor deactivation/rotation/reverse rotation conditions, and home sensor ON/OFF conditions.

FIG. 9A is a flowchart for explaining an operation in the transferring and applying process of the adhesive 65 to only the leading end of the rear surface of the print surface of the thermo-sensitive tape 11 in the feeding direction. FIG. 9B is a diagram illustrating a positional relationship among the tape cutter 6, the thermal head 18, and the adhesive transfer mechanism 64 in such an operation condition, and how the adhesive is transferred on the rear surface of the thermo-sensitive tape 11.

Note that a relationship illustrated in FIG. 9B between a distance (length) L1 from the thermal head 18 to the tape cutter 6 and a distance (length) L2 from the adhesive transfer mechanism 64 to the thermal head 18 satisfies a condition that L1<L2.

FIG. 9C illustrates, like FIG. 6C, timings of head UP/Down, transfer ON/OFF, motor deactivation/rotation/reverse rotation, and home sensor ON/OFF in such an operation condition. An arrow o in FIG. 9B indicates the feeding direction of the thermo-sensitive tape 11, while an arrow p indicates an advancement in time.

First, in FIGS. 9A and 9B, when the PC 59 instructs the start of printing, the CPU 55 refers to the output by the home sensor in the final condition (completion of initial setting) illustrated in FIGS. 6A, 6B, and 6C, and confirms that the sensor condition is ON. The CPU 55 causes the motor to reversely rotate, and to further reversely rotate by A steps at a time point at which the sensor condition changes to OFF from ON and deactivates the motor.

Accordingly, a preparation for printing completes. As illustrated in FIG. 9B, the thermo-sensitive tape 11 remains in the initial position, the motor is deactivated as illustrated in FIG. 9C, but had rotated in the reverse direction by the A steps as illustrated in FIG. 5, and thus the head condition is Down, the transfer condition is OFF, and the home sensor condition is OFF.

Next, power is supplied to the head, that is, a transmission of drive signals in accordance with printing information starts, and the motor is rotated in the positive direction to rotate and drive the platen roller. The thermo-sensitive tape 11 is fed together with the printing operation. In accordance with a fed rear end 65*a* of the transferred adhesive 65 when the preparation for printing has completed, printing 68 is formed on the front surface of the thermo-sensitive tape 11 at an equal length to the feeding distance of such a rear end.

When the length until the printing completes becomes the number of main scanning lines (L lines) in the sub scanning directions corresponding to "length L2-length L1" before the completion of printing, the motor is reversely rotated by "B steps-A steps" (see FIG. 5)

Accordingly, as illustrated in FIG. 9C, the head condition becomes Down (printing continued), the transfer condition becomes ON (transferring restarted), and the home sensor condition becomes OFF, and as illustrated in FIG. 9B, with an unprinted part 68*a* with a length q by what corresponds to L lines that the printing 68 should be continued being left on the front surface of the thermo-sensitive tape 11, a transfer restarting condition is set.

Subsequently, power supply to the head is restarted, and the motor rotates in the positive direction. Accordingly, the printing on the unprinted part 68*a* on the front surface of the thermo-sensitive tape 11 advances, and when the printing on the unprinted part 68*a* completes, the power supply to the head is terminated. At this time, a transferred part of the adhesive 65 with the length q by what corresponds to the length q of the unprinted part 68*a* having undergone the printing is formed on the rear surface of the thermo-sensitive tape 11.

Thereafter, with the power supply to the head being terminated, the motor is rotated in the positive direction to successively perform final feeding, and the motor is deactivated when the boundary between a leading end 65*b* of the transferred adhesive 65 and the rear end of the label 66 is positioned at the position of the tape cutter 6, and the tape cutter 6 is activated to cut the label 66.

Thereafter, like the case illustrated in FIG. 6C, when the power is turned OFF or no operation is given by the user for a predetermined time, as illustrated in FIG. 9C, the motor is reversely rotated to drive the cam gear sequence 26, and when the home sensor condition becomes ON, the head condition becomes UP (non-printing), and the transfer condition becomes OFF (non-transferring). Subsequently, the motor is deactivated.

The above-explanation was given of the example case in which the adhesive is transferred on only the leading end of the rear surface of the thermo-sensitive tape 11, but a label without an adhesive on the rear surface becomes necessary in some cases or a label with an adhesive on the whole rear surface becomes necessary in some cases in creation of the label 66.

The creation of a label without an adhesive on the rear surface can be easily realized by loading the thermo-sensitive tape 11 in the printing device 1 without an initial setting for partial transferring illustrated in FIGS. 6A to 6C, and by causing the motor to rotate in the positive direction while supplying power to the thermal head 18 with the head Down, transfer OFF, and home sensor OFF conditions that are a printing ready condition illustrated in FIGS. 9A to 9C.

Figures 10A, 10B, 10C:
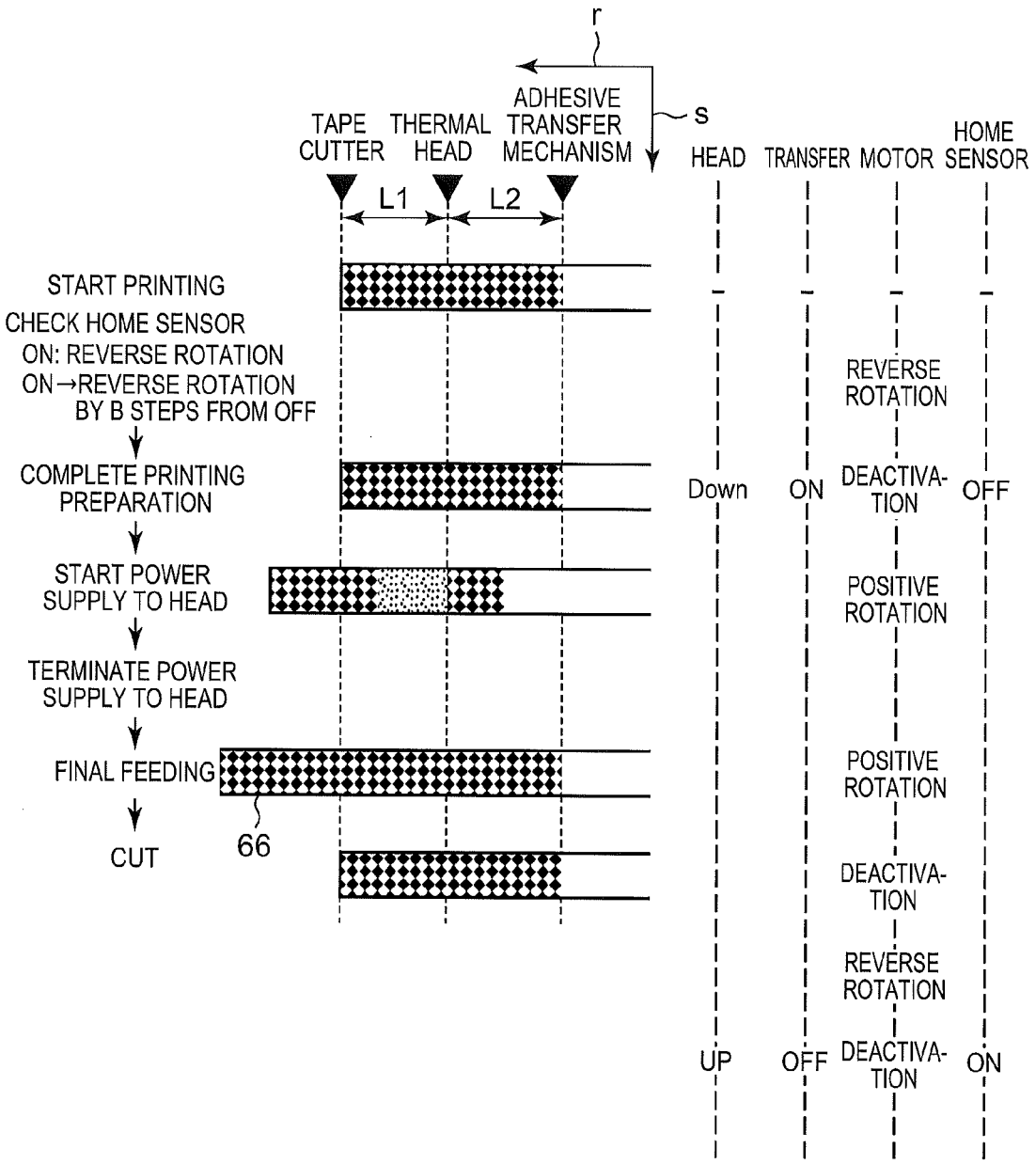
FIG. 10A is a flowchart for explaining a process executed by the printing device to transfer an adhesive to the whole rear surface of a thermo-sensitive tape.
FIG. 10B is a diagram illustrating an operation condition of the thermo-sensitive tape.
FIG. 10C is a diagram illustrating head UP/DOWN conditions, transfer ON/OFF conditions, motor deactivation/rotation/reverse rotation conditions, and home sensor ON/OFF conditions.

FIG. 10A is a flowchart for explaining an operation in the transferring and applying the process of the adhesive 65 to the whole rear surface of the print surface of the thermo-sensitive tape 11. FIG. 10B is a diagram illustrating a positional relationship among the tape cutter 6, the thermal head 18, and the adhesive transfer mechanism 64 in such an operation condition, and how the adhesive is transferred on the rear surface of the thermo-sensitive tape 11.

FIG. 10C is a diagram illustrating, likewise FIG. 9C, timings of head UP/Down, transfer ON/OFF, motor deactivation/rotation/reverse rotation, and home sensor ON/OFF in such an operation condition. In FIG. 10B, an arrow r indicates the feeding direction of the thermo-sensitive tape 11, while an arrow s indicates an advancement in time.

In FIGS. 10A, 10B and 10C, when the PC 59 instructs the start of printing, the CPU 55 refers to the output by the home sensor in the final condition (completion of initial setting) illustrated in FIGS. 6A, 6B and 6C, and confirms that the sensor condition is ON. The CPU 55 causes the motor to reversely rotate, and to further reversely rotate by B steps at a time point at which the sensor condition changes to OFF from ON and deactivates the motor.

Hence, a preparation for printing completes. As illustrated in FIG. 10B, the thermo-sensitive tape 11 remains in the initial position, the motor is deactivated as illustrated in FIG. 10C, but had rotated in the reverse direction by the B steps as illustrated in FIG. 5, and thus the head condition is Down, the transfer condition is ON, and the home sensor condition is OFF.

Next, power supply to the head is started, and the motor is rotated in the positive direction to rotate the platen roller. The thermo-sensitive tape 11 is fed together with the printing operation and the transferring operation of the adhesive. When the printing completes, the power supply to the head is terminated, and when the thermo-sensitive tape 11 is eventually fed until the print surface becomes a predetermined length to form the label 66, the tape cutter 6 is activated to cut the label 66, and the motor is deactivated.

Thereafter, like the case illustrated in FIGS. 6A to 6C, when power is turned OFF or no operation is given by the user for a predetermined time, as illustrated in FIG. 10C, the motor is reversely rotated to drive the cam gear sequence 26, and when the home sensor condition becomes ON, the head condition becomes UP (non-printing), the transfer condition becomes OFF (non-transferring), and the motor is deactivated.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A printing device comprising:

a feeder roller that feeds a printing target member;

a driver that rotates the feeder roller;

a printing section that performs printing on the printing target member;

a cutter that cuts the printing target member in a direction orthogonal to a feeding direction of the printing target member;

a transfer mechanism which causes a transfer member to contact with the printing target member while feeding the transfer member, the transfer member comprising a tape-shaped mat and an adhesive on a first side of the tape-shaped mat, so as to transfer the adhesive onto a surface of the printing target member where no printing is performed; and a controller that selectively controls the transfer mechanism to cause transfer of the adhesive onto the surface of the printing target member where no printing is performed, wherein the controller controls transfer mechanism to transfer the adhesive onto the surface of the printing target member at a predetermined interval in a feeding direction of the printing target member such that the adhesive extends in a dot manner or in a linear manner in a direction orthogonal to the feeding direction of the printing target member, and wherein the controller controls the cutter to cuts the printing target member at a position based on the predetermined interval.

2. The printing device according to claim 1, wherein the transfer mechanism comprises a pair of transfer rollers which are configured to hold the printing target member and the transfer member therebetween and to come into and out of contact with each other via the printing target member and the transfer member.

3. The printing device according to claim 2, wherein the transfer member is wound between a feeding roller and a winding roller in such a way that a second side of the tape-shaped mat on which no adhesive is provided contacts one of the pair of transfer rollers.

4. The printing device according to claim 3, wherein the transfer member is retained in a cartridge together with the one of the pair of transfer rollers, the feeding roller, and the winding roller, the cartridge being freely detachable from the printing device.

5. The printing device according to claim 4, wherein the cartridge comprises a plurality of cartridges each including a respective transfer member having a different adhesive force of an applied adhesive thereon with respect to adhesives on the other respective transfer members.

6. The printing device according to claim 2, wherein the printing target member comprises a thermo-sensitive tape.

7. The printing device according to claim 1, wherein the printing section comprises a thermal head, and the feeder roller comprises a platen roller.

8. The printing device according to claim 7, wherein the printing target member comprises a thermo-sensitive tape.

9. The printing device according to claim 1, wherein the printing target member comprises a thermo-sensitive tape.

* * * * *

UNITED STATES PATENT AND TRADEMARK OFFICE

CERTIFICATE OF CORRECTION

PATENT NO. : 9,056,507 B2
APPLICATION NO. : 13/949846
DATED : June 16, 2015
INVENTOR(S) : Yasushi Murai et al.

It is certified that error appears in the above-identified patent and that said Letters Patent is hereby corrected as shown below:

In the claims

Column 16, claim 1, line 22, after “controls” insert --the--.

Column 16, claim 1, line 29, delete “cuts” and insert --cut--.

Signed and Sealed this
Fifth Day of April, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,056,507 B2
APPLICATION NO. : 13/949846
DATED : June 16, 2015
INVENTOR(S) : Yasushi Murai et al.

It is certified that error appears in the above-identified patent and that said Letters Patent is hereby corrected as shown below:

Column 16, line 21, (claim 1, line 20), after “controls” insert --the--.

Column 16, line 28, (claim 1, line 27), delete “cuts” and insert --cut--.

This certificate supersedes the Certificate of Correction issued April 5, 2016.

Signed and Sealed this
Seventeenth Day of May, 2016

Michelle K. Lee

Michelle K. Lee
*Director of the United States Patent and Trademark Office*